United States Patent [19]

Pustka et al.

[11] 4,295,635

[45] Oct. 20, 1981

[54] UNIVERSAL PNEUMATIC BELLOWS JACK LIFTER

[75] Inventors: Zdenek Pustka; Oldrich Krejcir, both of Liberec, Czechoslovakia

[73] Assignee: Vysoka skola strojni a textilni, Liberec, Czechoslovakia

[21] Appl. No.: 182,302

[22] Filed: Aug. 28, 1980

[30] Foreign Application Priority Data

Aug. 30, 1979 [CS] Czechoslovakia ..... 5907-79

[51] Int. Cl.[3] ..... B66F 3/24

[52] U.S. Cl. ..... 254/93 HP

[58] Field of Search ..... 254/93 HP, 29 A, 106; 29/252; 74/18.2; 92/91-93, 37-39

[56] References Cited

U.S. PATENT DOCUMENTS

| | | | |
|---|---|---|---|
| 1,745,959 | 2/1930 | Steiner | 254/93 HP X |
| 2,613,610 | 10/1952 | Saalfrank | 92/37 X |
| 3,523,679 | 8/1970 | Clay | 254/93 HP |
| 4,026,110 | 5/1977 | Engström | 92/37 X |

*Primary Examiner*—Robert C. Watson

[57] ABSTRACT

Universal pneumatic bellows jack lifter for generating pull and pressure forces comprising two coaxial bellows of different diameter having on one end a common closing cover supported by a stable base. Both other ends of both bellows are closed by individual covers firmly connected by a rod which transmits the required pull or pressure force to a load.

5 Claims, 3 Drawing Figures

UNIVERSAL PNEUMATIC BELLOWS JACK LIFTER

BACKGROUND OF THE INVENTION

The invention relates to a universal pneumatic bellows jack lifter capable of generating both a pushing and a pulling force, thus facilitating the manipulation of loads and extending the range of application of pneumatic bellows jack lifters.

Actually known pneumatic bellows jack lifters comprise a single elastic bellows, the walls of which are mostly made of rubber reinforced by cords. The bellows is on one end closed by a cover, the face wall of which is designed when lifting loads as a support and as a base. The other end of the bellows is closed by a cover, where an opening for the supply of pressure air is provided and alternatively also a valve control device and some element for supporting the lifted load, having mostly the shape of an axial guiding column.

These pneumatic jack lifters in the course of manipulation with the load always have to be situated between a supporting surface of a base and the load, since they are able to generate only a pressure force which lifts the load. They cannot therefore be used where the load has to be lifted by a pull force.

SUMMARY OF THE INVENTION

It is an object of this invention to provide a pneumatic bellows jack lifter capable of lifting a load both by a pressure and by a pull force. The universal pneumatic bellows jack lifter according to this invention comprises two coaxial elastic bellows of different diameters having on one end of both said bellows a common supporting closing cover with a central opening, whereas both second ends of both bellows are closed each by a cover which are both connected by a firm bar provided with a termination for manipulation with the load. The common supporting and closing cover can be advantageously vaulted in the direction into the bellows of larger diameter. It is equally advantageous if the central opening of the common supporting and closing cover has beveled or rounded edges and forms by its circumference a guiding for the firm bar consisting for instance of a rod, a tube or of a tube with a rod.

The universal pneumatic bellows jack lifter according to this invention has on one end of each bellows a common closing cover serving according to need for its supporting or suspending by or on a suitable base. The bellows of larger diameter is always situated from the common closing cover in the direction of movement of the lifted load. The load can rest either against the face wall of the second closing cover of the bellows of larger diameter or against a suitably arranged end of the rod, tube or of the tube with a rod adapted for manipulation with the load on this end of the jack lifter. The load, however, can also be suspended on a suitably arranged end of the rod, tube or tube with rod adapted for manipulation with the load on the opposite end of the jack lifter and lifted by a pull force. Both the pressure and pull force generated by the universal pneumatic bellows jack lifter are always determined by the product of the difference of effective surfaces of both bellows and of the overpressure of air by which the lifter is filled. The vaulting of the common suspending or supporting cover in a direction inside the bellows of larger diameter permits the reduction of the height of the universal pneumatic bellows jack lifter according to this invention. If the central opening of the common supporting or suspending cover has beveled or rounded edges and forms by its circumference a guiding for the rod, tube or tube with rod connecting covers of both bellows on remaining ends, the resistance against sidewise displacement of the bellows is increased, and thus the safety of work in the course of manipulation of the jack lifter with the load is also increased.

DESCRIPTION OF DRAWINGS

Three examplary embodiments of the universal pneumatic bellows jack lifter according to this invention are shown in the attached drawings in longitudinal sectional elevation.

DESCRIPTION OF PREFERRED EMBODIMENTS

Figure 1:
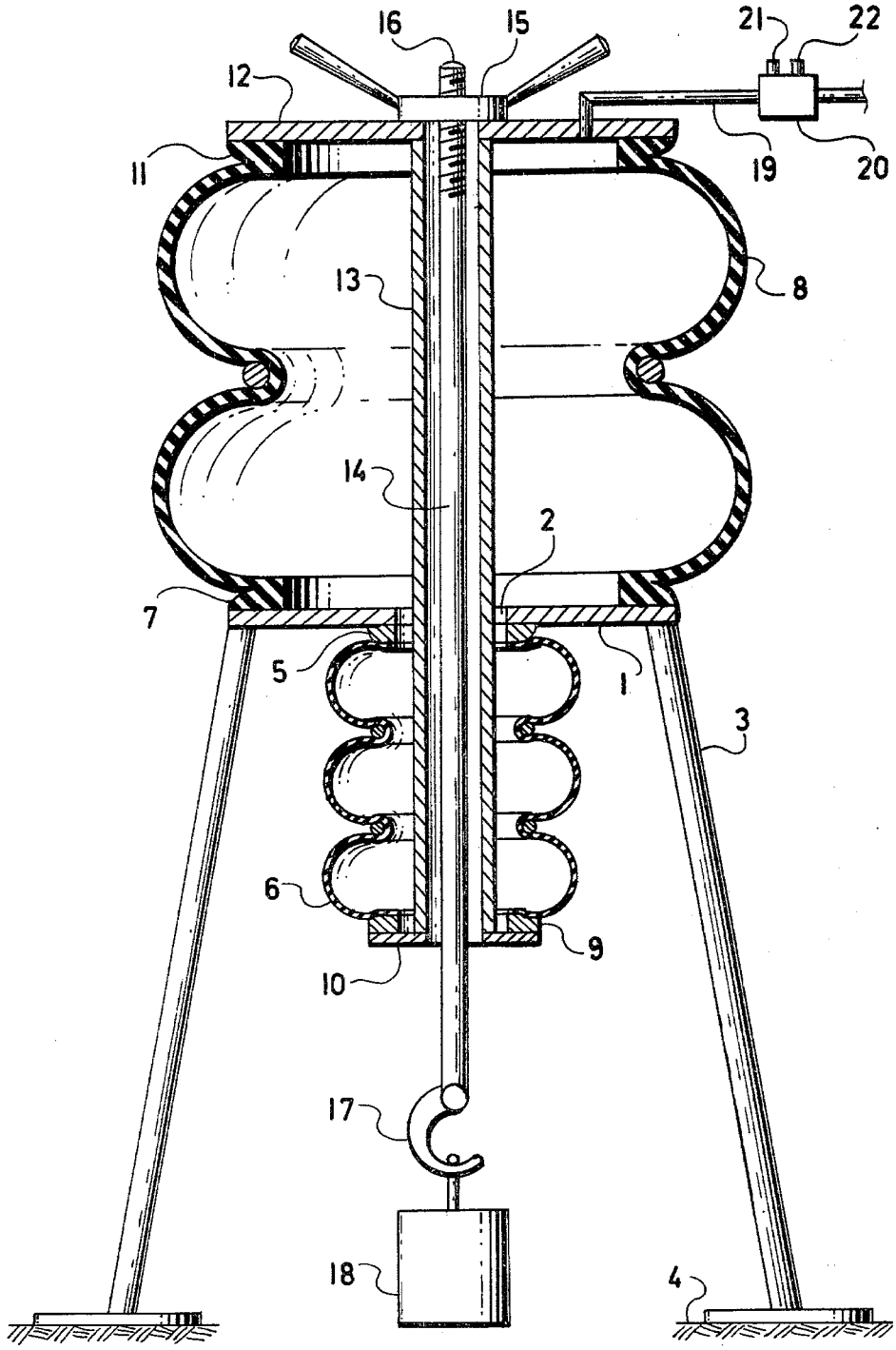
FIG. 1 shows a jack lifter with a common supporting cover where one end of each bellows is closed by a cover connected by a tube and rod, having a termination designed for suspension of a load lifted by pull.

The universal pneumatic bellows jack lifter according to FIG. 1 has a common supporting closing cover 1 for both bellows, cover 1 having a central opening 2 therethrough which connects the interiors of bellows 6 and 8, said cover 1 supported by bars 3 resting on a selected base 4. A bellows 6 of smaller diameter is connected by its end 5 to the cover 1 in the same direction as the supporting bars 3 and the bellows 8 of larger diameter with its end 7 in the opposite direction. The other lower end 9 of the bellows 6 of smaller diameter is closed by a cover 10 and the other upper end 11 of the bellows 8 of larger diameter is closed by a cover 12. Both covers 10 and 12 are connected by a tube 13, through which a rod 14 with a nut 15 on the upper threaded end 16 passes. The other end of the rod 14 has a hook 17 adapted for suspension of a lifted load 18. All three closing covers 1, 10 and 12 are connected to the bellows 6, 8 by screws (not shown). The cover 12 on the upper end 11 of the bellows 8 of larger diameter is provided with a supply conduit 19 of pressure air with a valve system 20 controlled by a push button 21 for filling and by a push button 22 for emptying the jack lifter.

When manipulating with a load 18 suspended on the hook 17 with the lifter of FIG. 1, first the length of the rod 14 in the tube 13 is adjusted so that the face of the nut 15 rests on the cover 12 on the upper end 11 of the bellows 8 of larger diameter. After pressing the push button 21, filling air starts to flow into the jack lifter by way of the valve system 20 and the supply conduit 19. The load 18 suspended on the hook 17 is gradually lifted by a pull force, the magnitude of such force being equal to the product of the difference of effective surfaces of both bellows 6, 8 and of the overpressure in the jack lifter. In the course of lifting the load 18, the bellows 8 of larger diameter gradually extends, whereas the bellows 6 of smaller diameter is gradually compressed. The lifted load 18 can be gradually lowered by release of pressure air from the jack lifter by means of the push button 22. In the course of lowering the load 18 the bellows 8 of larger diameter is compressed whereas the bellows 6 of smaller diameter is extended.

Figure 2:
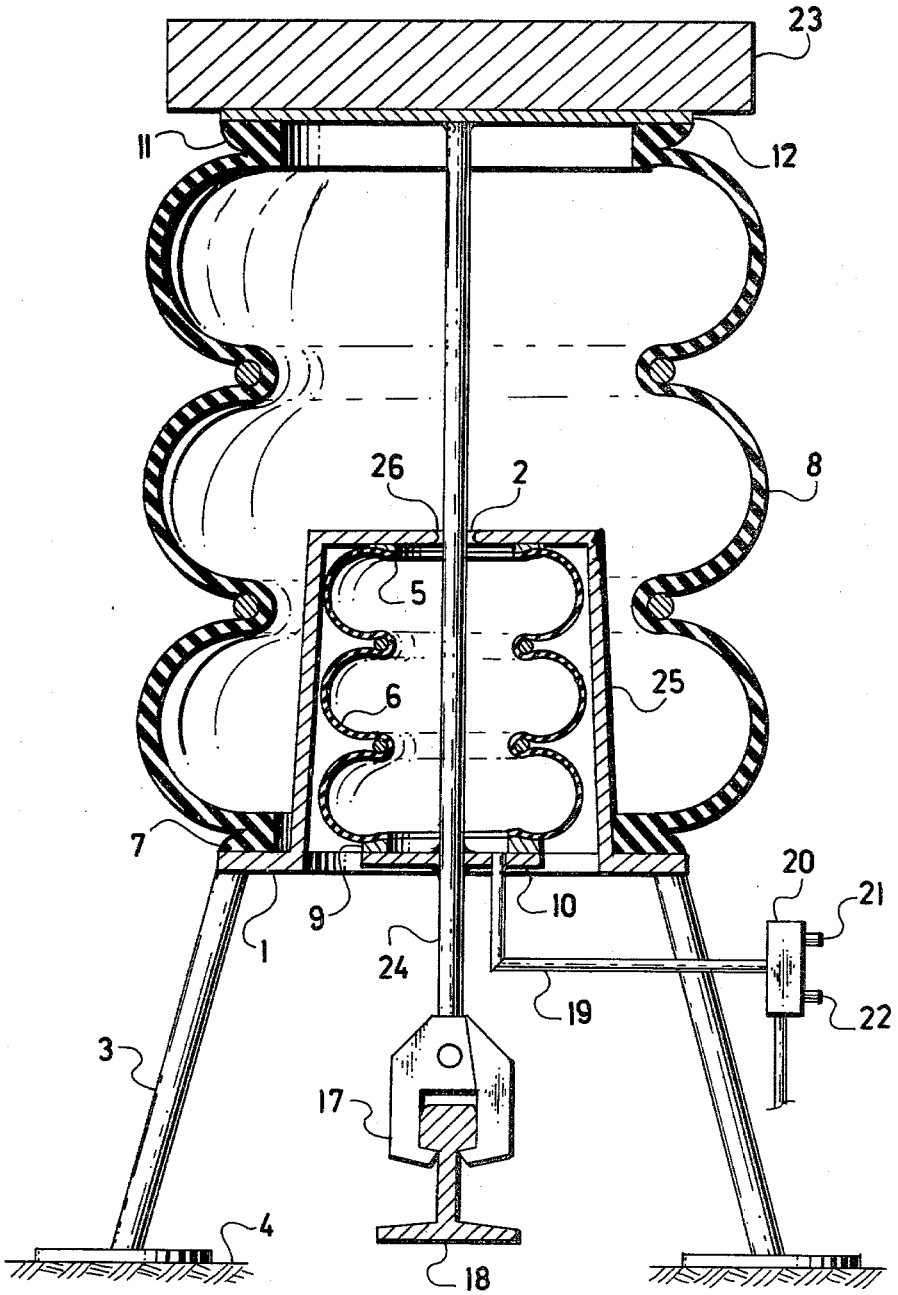
FIG. 2 shows a jack lifter with a common supporting cover having a vault formed inside the bellows of larger diameter, the central opening of which cover has rounded edges and forms by its circumference a guiding for the rod connecting covers on ends of both bellows, said jack lifter being adapted to lift a supported load by pressure and a suspended load by pull.

The universal pneumatic bellows jack lifter according to FIG. 2 has a common supporting closing cover 1 supported by bars 3 resting on a selected base 4. A bellows 8 of larger diameter is connected by its lower end 7 to the common closing cover 1 in a direction opposite to that of the bars 3, and the bellows 6 of smaller diameter is connected thereto in the same direction. A closing cover 12 is connected to the other, upper end 11 of the bellows 8 of larger diameter, on which cover 12 the load 23 rests, the load being lifted by a pressure force. A closing cover 10 is fixed to the lower end 9 of the bellows 6 of smaller diameter. Both covers 10, 12 are connected by a rod 24 provided on its end with a hook or gripper 17 adapted for the suspension of a load 18, lifted by pull. The common supporting closing cover 1 has a vault 25 formed in the upward direction inside the bellows 8 of larger diameter. The central opening 2 in the upper wall of vault 25 has rounded edges and forms by its circumference 26 with clearance a guiding for the rod 24 with the suspended load 18. The upper end of bellows 6 is open the interior of bellows 6 and 8 being connected through central opening 2. All three closing covers 1, 10 and 12 are fixed to the bellows 6, 8 by screws (not shown). The cover 10 on the lower end 9 of the bellows 6 of smaller diameter is provided with a supply conduit 19 of pressure air with a valve system 20 controlled by a push button 21 for filling and by a push button 22 for emptying the jack lifter.

In the course of lifting a supported load 23 by a pressure force or of a suspended load 18 by a pull force and also in the course of its lowering by the apparatus of FIG. 2, the valve system 20 with the control buttons 21, 22 is operated as in the preceeding case (FIG. 1). The manipulation with the jack lifter is of course safer, as the rod 24 when there is a suspended load 18, or when a load 23 is supported by cover 12, is guided by the circumference 26 of the central opening 2 of the common closing cover 1, so that there is no danger of a loss of stability of the bellows 6, 8. As the bellows 6 of smaller diameter is situated within the vault 25 formed in the common supporting closing cover 1, the overall construction height of the jack lifter is smaller, which is advantageous.

Figure 3:
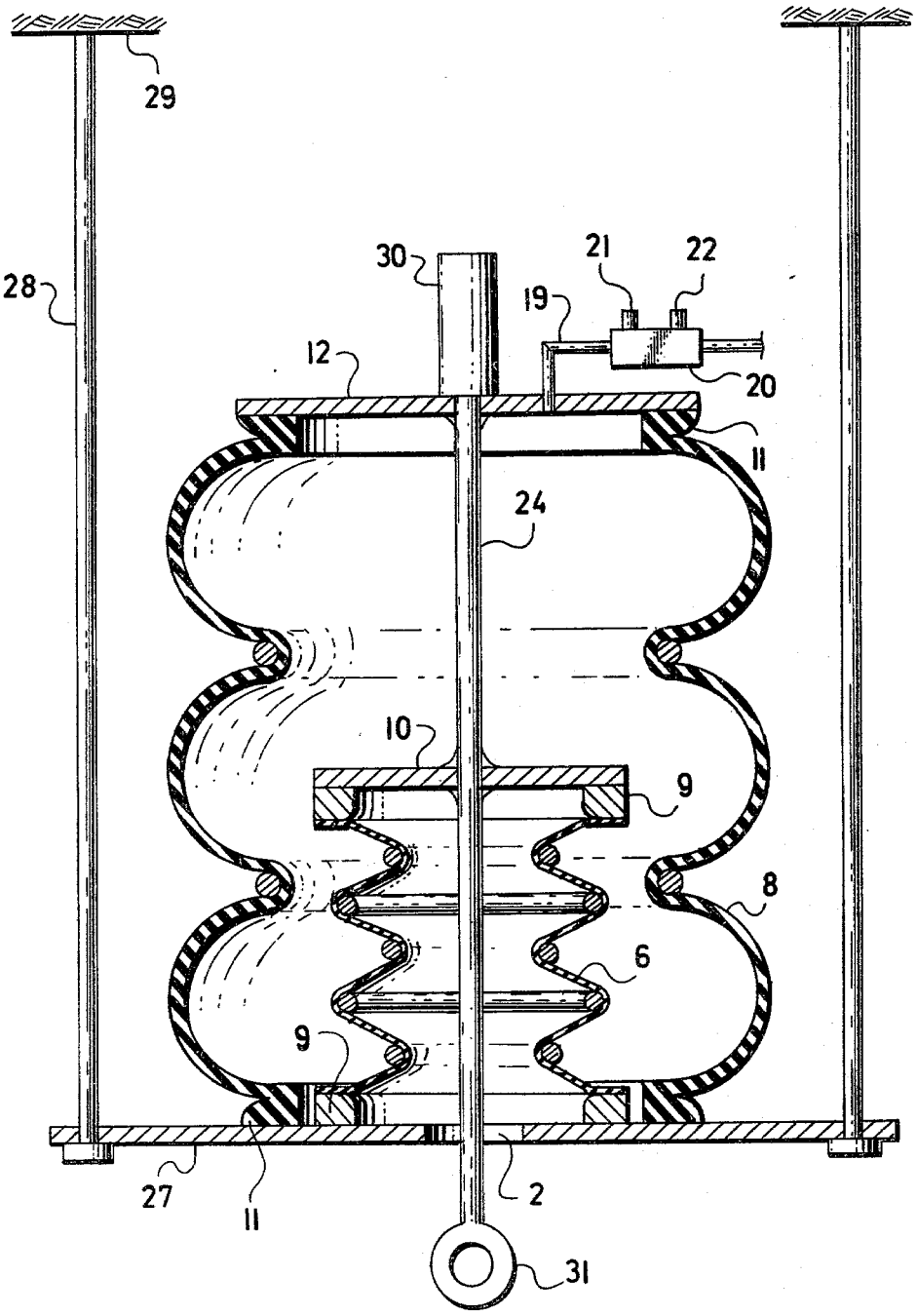
FIG. 3 shows a jack lifter with a common suspended cover of both bellows, the other ends of both bellows closed by covers connected by a rod having on one end a termination adapted for suspension of a load lifted by pull, on the other end there being a termination adapted for supporting a load by pressure.

The universal pneumatic bellows jack lifter according to FIG. 3 has a common suspension closing cover 27 with a central opening 2 connected by suspension bars 28 to a selected fixed support base 29. Both bellows 6,8 are connected by their ends 5,7 to the cover 27 on the same side of the cover 27. The bellows 8 of larger diameter has fixed on its other lower end 11 a closing cover 12, the bellows 6 of smaller diameter has fixed on its lower end 9 a closing cover 10. Both covers 10, 12 are fixedly connected to a central rod 24, rod 24 having on its upper end a guiding column 30 for supporting a load (not shown) lifted by upward pressure and on its lower end an eyelet 31 for the suspension of a load (not shown) lifted by an upward pull. All three covers 27, 10, 12 are fixed to the bellows 6,8 by screws (not shown). The cover 12 on the upper end 11 of bellows 8 of larger diameter is provided with a supply conduit 19 of pressure air with a valve system 20 controlled by a push button 21 for filling and by a push button 22 for emptying the bellows 8 of the jack lifter. In this case, the interior of bellows 6 is isolated from the interior of bellows 8, the exterior of bellows 6 being subjected to the pressure of air in bellows 8.

In the course of lifting a supported load by an upward pressure force on cover 12, or of a suspended load by pull force on rod 24, and when lowering the load, the process with the lifter of FIG. 3 proceeds in the same way as in the preceeding cases (FIGS. 1 and 2). The lifting force is again determined by the product of the difference of effective surfaces of both bellows 6,8 and of the overpressure of air in the jack lifter. When lifting loads, both bellows 6,8 are simultaneously extended, whereas in the course of lowering the load both are simultaneously compressed.

The bellows 6,8 of all three jack lifters shown in the attached drawings are indicated diagrammatically only. They are made by commonly known methods from rubber reinforced by cords, and on their ends they are provided with packing faces and with tightening rings with tightening screws. Bellows 8 is provided with external restricting rings 8*a* at the roots of its pleats, and bellows 6 is is also provided with internal restricting rings at the peaks of its pleats.

The universal pneumatic bellows jack lifter is not designed solely for manipulation with loads. It can be also advantageously utilized as an extending device, as pneumatic stripper and generally as a servo cylinder for generating pull and pressure forces.

Although the invention is illustrated and described with reference to a plurality of preferred embodiments thereof, it is to be expressly understood that it is in no way liminted to the disclosure of such a plurality of preferred embodiments, but is capable of numerous modifications within the scope of the appended claims.

We claim:

1. Universal pneumatic bellows jack lifter comprising two coaxial elastic bellows of different diameter, one end of each of said bellows being provided with a common closing cover adapted to be fixed to a suitable base, said common closing cover having a central opening, the remaining ends of both bellows being closed by further covers mutually connected by a bar, said bar being provided with at least one termination for the manipulation of a load and means for selectively introducing fluid under pressure into both of the bellows and exhausting it therefrom.

2. Universal pneumatic bellows jack lifter as in claim 1, wherein the central opening of the common closing cover of both bellows having smooth edges and forming by its circumference a guiding for the bar adapted for the manipulation of a load.

3. Universal pneumatic bellows jack lifter comprising two coaxial elastic bellows of different diamter, one end of each of said bellows being provided with a common closing cover adapted to be fixed to a suitable base, a vault on the common closing cover, the vault projecting into the interior of the bellows of larger diameter said common closing cover having a central opening, the remaining ends of both bellows being closed by further covers mutually connected by a bar, said bar being provided with at least one termination for the manipulation of a load.

4. Universal pneumatic bellows jack lifter comprising two coaxial elastic bellows of different diameter, one end of both said bellows being provided with a common closing cover adapted to be fitted to a suitable base, said common closing cover having a central opening, the remaining ends of both bellows being closed by further covers, means connected to the further cover of said remaining end of the bellows of larger diameter providing for the manipulation of a load, and means for selectively introducing fluid under pressure into both bellows and exhausting it therefrom.

5. Universal pneumatic bellows jack lifter as in claim 4, wherein the further covers of the two bellows are connected by the means which provides for the manipulation of a load.

* * * * *